US011124954B2

(12) United States Patent
Carver et al.

(10) Patent No.: US 11,124,954 B2
(45) Date of Patent: Sep. 21, 2021

(54) IN-THE-BOWL DISPENSING DEVICE

(71) Applicant: Reckitt Benckiser (Brands) Limited, Slough (GB)

(72) Inventors: Kris Carver, Hull (GB); Jesse Delgigante, Verona, NJ (US); Henry Matthew Lawrence Fletcher, Cambridge (GB); John Kenneth Hainsworth, Cambridge (GB); Iain Christopher Smith, Cambridge (GB); Alim Thawer, Cambridge (GB)

(73) Assignee: Reckitt Benckiser (Brands) Limited, Slough (GB)

( * ) Notice: Subject to any disclaimer, the term of this patent is extended or adjusted under 35 U.S.C. 154(b) by 0 days.

(21) Appl. No.: 16/614,124

(22) PCT Filed: Jun. 5, 2018

(86) PCT No.: PCT/GB2018/051533
§ 371 (c)(1),
(2) Date: Nov. 15, 2019

(87) PCT Pub. No.: WO2018/224818
PCT Pub. Date: Dec. 13, 2018

(65) Prior Publication Data

US 2020/0173157 A1 Jun. 4, 2020

(30) Foreign Application Priority Data

Jun. 6, 2017 (GB) ..... 1708969

(51) Int. Cl.
*E03D 9/03* (2006.01)
*E03D 9/00* (2006.01)
*E03D 9/02* (2006.01)

(52) U.S. Cl.
CPC ..... *E03D 9/032* (2013.01); *E03D 9/005* (2013.01); *E03D 2009/028* (2013.01)

(58) Field of Classification Search
CPC ..... E03D 2009/028; E03D 9/005; E03D 9/03–033
See application file for complete search history.

(56) References Cited

U.S. PATENT DOCUMENTS 3,946,448 A * 3/1976 Sioufy ..... E03D 9/032 4/223
3,999,226 A * 12/1976 Wolf ..... E03D 9/032 4/225.1

(Continued)

FOREIGN PATENT DOCUMENTS

CN 102844423 A 12/2012
CN 104629961 A 5/2015

(Continued)

OTHER PUBLICATIONS

International Search Report and Written Opinion of the International Searching Authority for corresponding application PCT/GB2018/051533 dated Oct. 29, 2018.

(Continued)

*Primary Examiner* — David P Angwin
*Assistant Examiner* — Nicholas A Ros
(74) *Attorney, Agent, or Firm* — Norris McLaughlin PA

(57) ABSTRACT

Disclosed is an in-the-bowl dispensing device designed to dispense a composition after the flush of the toilet bowl is complete. In this manner the composition is retained in the toilet bowl until the toilet bowl is flushed by the next user.

18 Claims, 7 Drawing Sheets

(56) References Cited

U.S. PATENT DOCUMENTS

| | | | | |
|---|---|---|---|---|
| 5,958,334 | A * | 9/1999 | Haddon | A61L 9/04 422/5 |
| 10,472,811 | B2 * | 11/2019 | Carver | E03D 9/032 |
| 2006/0123528 | A1 * | 6/2006 | Pagani | E03D 9/032 4/231 |
| 2013/0042887 | A1 | 2/2013 | Avery et al. | |
| 2016/0333560 | A1 * | 11/2016 | Goulart | C11D 1/75 |

FOREIGN PATENT DOCUMENTS

| | | | | |
|---|---|---|---|---|
| EP | 1026331 | A1 | 8/2000 | |
| EP | 1072728 | A2 | 1/2001 | |
| EP | 1260577 | * | 11/2002 | C11D 17/00 |
| EP | 1260577 | A2 | 11/2002 | |
| EP | 1408164 | A2 | 4/2004 | |
| WO | 0104428 | A1 | 1/2001 | |
| WO | WO2002040788 | * | 5/2004 | E03D 9/03 |
| WO | 2017129948 | A1 | 8/2017 | |

OTHER PUBLICATIONS

GB Search Report for corresponding application GB 1708969.9 dated Nov. 22, 2017.

International Preliminary Report on Patentability dated Dec. 19, 2019.

* cited by examiner

IN-THE-BOWL DISPENSING DEVICE

This is an application filed under 35 USC 371 based on PCT/GB2018/051533, which in turn is based on UK patent application number 1708969.9 filed on 6 Jun. 2017. The present application claims the full priority benefit of these prior applications and herein incorporates by reference the full disclosures of these prior applications.

BACKGROUND OF THE INVENTION

The invention provides an in-the-bowl dispensing device (ITB) for use with a toilet.

The ITB of the invention is preferably designed to dispense a composition into a toilet bowl at a specific interval. The composition is preferably dispensed at the end of the flush of the toilet bowl or shortly after the flush has completed. The composition will remain in the toilet bowl after flushing is complete till the next flush to preferably provide, for example, a fragrancing and/or malodor reduction or elimination benefit.

When a person enters a bathroom to use a toilet bowl, they prefer that the air in the bathroom is devoid of malodor. Such can be problematic particularly where a prior user of the bathroom has defecated into the toilet bowl, even though the prior user has flushed the toilet bowl after use. The ITB of the present invention provides a solution to this problem.

STATEMENT OF INVENTION

A device for dispensing a composition into a toilet bowl after flushing, the device comprising:

a) a container, preferably a bottle, containing a composition suitable for dispersing into a toilet bowl;
b) a supporting cage supporting the container, the supporting cage having a means for conveying the composition to a dosing cup;
c) a lever arm pivotably connected to the supporting cage by a pivot point; the lever arm comprising: the dosing cup, the dosing cup being preferably disposed on the lever arm on distal to the pivot point; and
d) a receptacle for temporarily retaining a portion of the flow of water during a toilet flush; a biasing means in contact with the lever arm; wherein the receptacle comprises one or more drainage holes;
e) a suspension means for suspending the supporting cage from a portion of the toilet bowl to position the supporting cage within the flow of water during a toilet flush such that at least a portion of the flow of water is directed into the receptacle during a toilet flush; and wherein during the toilet flush, the weight of the flush water retained in the receptacle causes the lever arm to rotate from its initial biased position about the pivot point and cause the composition to move from the container to the dosing cup; and further wherein at the end of the toilet flush, the lever arm is biased about the pivot point by the biasing means to its initial position and causes the composition to be dispensed from the dosing cup into the toilet bowl.

After the flushing operation has ceased or is nearly completed, the present invention releases a composition to the bowl. Preferably the composition is a liquid composition. In a preferred embodiment, this liquid composition in part comprises both fragrance and an oil that float on top of the surface of the water remaining in the bowl. In this manner a fragrancing benefit is provided to the toilet bowl and a barrier is created on the water surface.

When a subsequent user defecates into the toilet bowl, malodors associated with the feces are trapped beneath the oil barrier thus eliminating or reducing the amount of malodor emitted from the feces into the air within the bathroom. Additionally, more fragrance is released into the air by virtue of the turbulence created within the toilet bowlwater. In this manner, in a preferred embodiment, the ITB of provides a malodor elimination or reduction and/or fragrancing benefit.

The ITB of the present invention is able to provide such a dual benefit by means of the use of a container (e.g., a bottle) of a liquid fragrancing and oil (or barrier oil) composition. In the preferred embodiment the bottle of the fragrancing composition is inverted. By "inverted" it is meant that the bottle opening is in a downward position facing in the general direction of the bottom of the toilet bowl. The bottle is preferably removably attached to a supporting cage which in turn is hung from the rim of the toilet bowl by a suspension means, for example, a hook, so as to be in the path of the flushing water. Upon insertion of the bottle into the cage, the closure(s) covering the mouths of the bottle may be opened by a piercing structure or other means for opening the bottle. The contents of the inverted bottle are thus exposed to atmospheric pressure while retained in the supporting cage and may flow out of the inverted bottle through a liquid flow chamber which may comprise a portion of the piercing structure.

Associated with the supporting cage is a lever arm which is able to rotate around a pivot point which is also associated with and a part of the supporting cage. The lever arm is optionally, but preferably, equipped at one end with a receptacle for temporarily capturing and retaining a portion of the flush water during a toilet flushing operation. The receptacle preferably has one or more drainage holes for releasing back into the toilet bowl, over a period of time that exceeds the time for a flushing operation of the toilet bowl to be completed, all or a majority of that portion of the flush water temporarily captured by the receptacle. Also associated with the lever arm are is a displacement element which may be, for example, in the form of a cup. These displacement element is hereinafter referred to as a "dosing cup". The dosing cup is in fluid communication with the bottle of fragrancing composition.

In contact with the lever arm and abutting the supporting cage is a biasing element, such as a spring, which biases the lever arm in a position around the pivot point such that the dosing cup may move in an upward and downward position in relation to the liquid flow chamber of the bottle of cleaning and fragrancing composition.

The operation of a preferred embodiment of the ITB of the present in invention is hereinafter described.

In its initial or pre-flush position, no liquid is dispensed from the ITB into the toilet bowl. The lever arm is biased by the spring into a position which is approximately horizontal. When the closure of the bottle of fragrancing composition is pierced, the dosing cup in the pre-flush position effectively prevents the contents of the liquid flow chamber entering the toilet bowl.

In the second or flushing position, when a user flushes the toilet, a portion of the flush water contacts a deflector ramp. The deflector ramp is may be a part of the lever arm, but it may instead be associated with the supporting cage. The deflector ramp directs a portion of the flush water to the receptacle at one end of the lever arm. This portion of the flush water is temporarily retained in the receptacle. The weight of the retained flush water biases the lever arm partially around the pivot point, against the force of the spring, such that the receptacle moves in a downwards direction toward the bottom of the toilet bowl.

This movement or tilting of the lever arm moves the dosing cup downward and away from liquid flow chamber associated with the bottle containing the composition. By moving in this position, available volume in the dosing cup is increased and fluid communication between the dosing cup and the liquid flow chamber for the fragrancing composition is temporarily disrupted. Air is thus permitted to enter the bottle containing the fragrancing composition and, as a result, an additional volume of fragrancing composition can flow downward through the liquid flow chamber and into the second dosing cup. This continues until equilibrium between the contents of the bottle of fragrancing composition and the level of fragrancing composition in the second dosing cup is reached. Factors affecting this equilibrium similarly include gravity, the surface tension and viscosity of the fragrancing composition, the geometry of the liquid flow chamber and the geometry of the dosing cup. These factors are all considered so that the level of fragrancing composition in the dosing cup is below the top of the dosing cup.

There is no discharge from the dosing cup in the flush position.

Drainage holes are preferably located in the receptacle. Preferably the drainage hole(s) in the receptacle is specifically sized such that when all or nearly all of the flush water temporarily captured by the receptacle has been released back to the toilet bowl, the flushing operation of the bowl has been or is near completion. With the weight of the captured flush water thus diminished or removed from the lever arm, in the third or post-flush position, the lever arm is biased by the spring around the pivot point in a manner such that the dosing cup is moved downward back to its initial pre-flush.

As the dosing cup is moved upwards in this manner, a volume of the composition is displaced from the second dosing cup via a drip point on the dosing cup. This displacement is again attributable to the Archimedes Principle. Due to its oily characteristics and the fact that the flushing operation of the toilet bowl has or nearly has ceased, the displaced fragrance composition (a micro emulsion) is able to provide a fragrancing benefit to the toilet bowl and spread across the top of the water remaining in the toilet bowl to create a barrier against malodor emanating from the toilet bowl upon subsequent use of the toilet bowl by a user. In this manner a malodor reduction and fragrancing benefit is provided.

A more detailed description of preferred embodiment of the invention in addition to the alternative embodiments of the invention follows in conjunction with the drawings.

BRIEF DESCRIPTION OF THE FIGURES

An exemplary embodiment of the present invention will now be described with reference to the drawings in which.

DETAILED DESCRIPTION OF THE INVENTION

Figure 1:
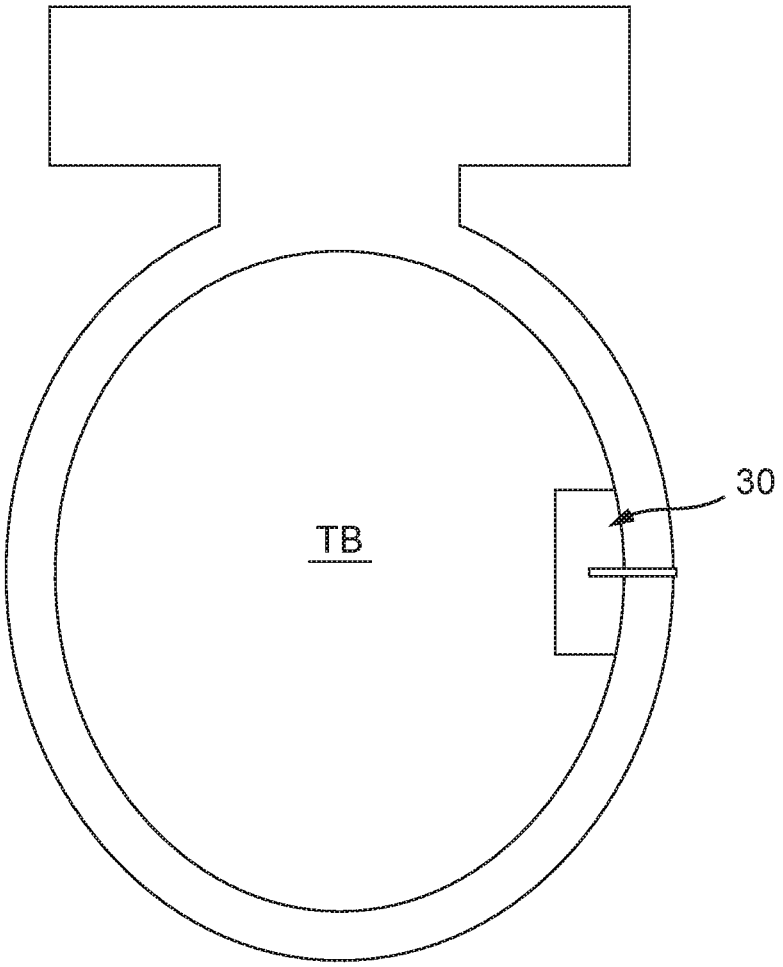
FIG. 1 depicts a top plan view of an embodiment of the ITB of the invention suspended on the inside of a toilet bowl.
Figure 2:
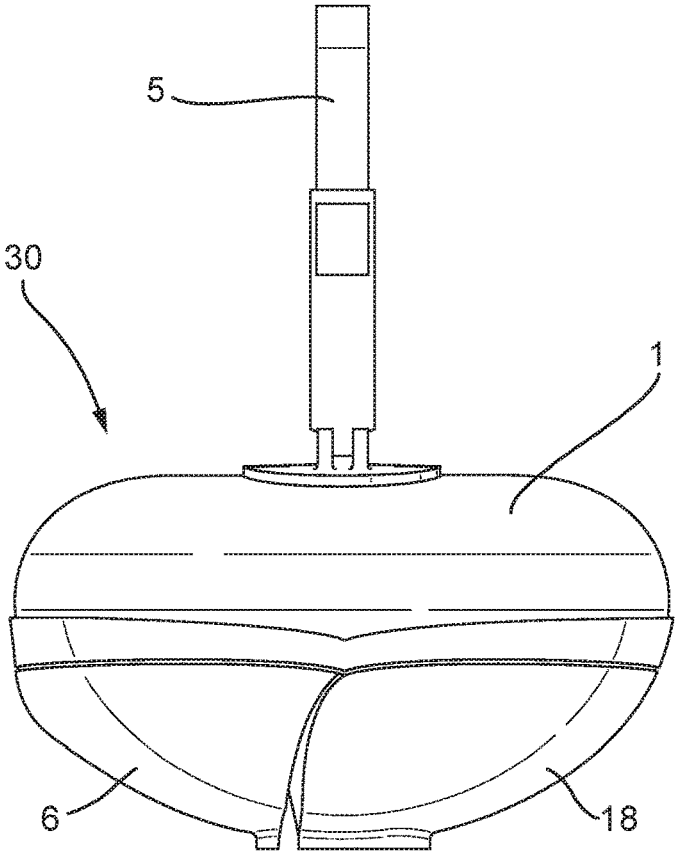
FIG. 2 is face on view of an embodiment of the ITB of the present invention.
Figure 3:
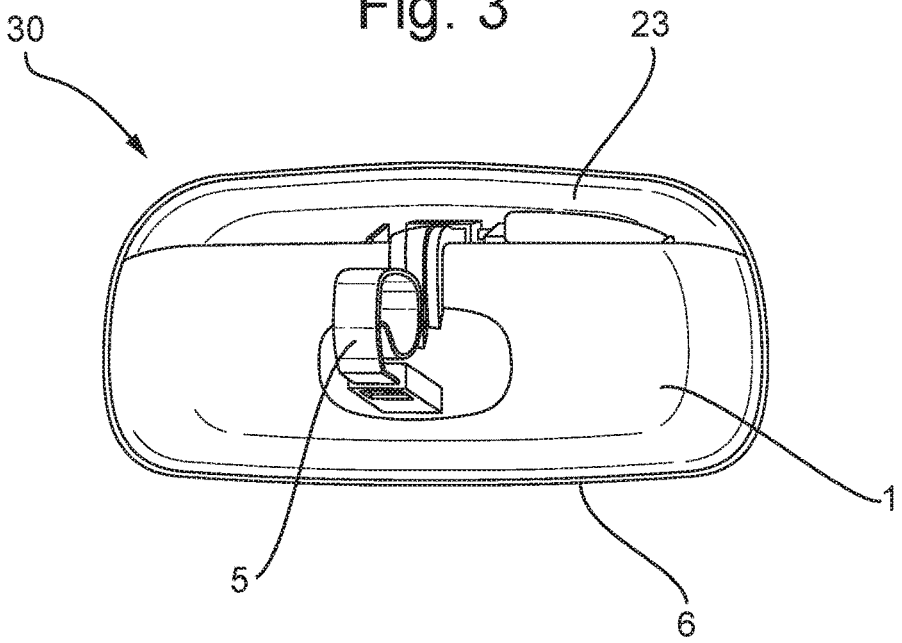
FIG. 3 is a top view of an embodiment of the ITB of the invention.
Figure 4:
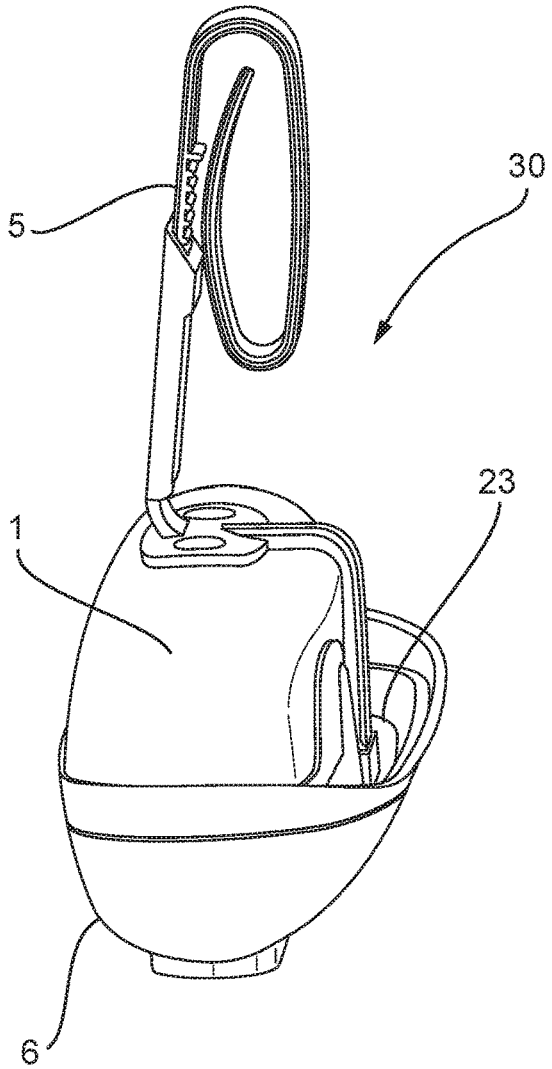
FIG. 4 is a three quarters view of an embodiment of the supporting cage and deflector ramp.
Figure 5:
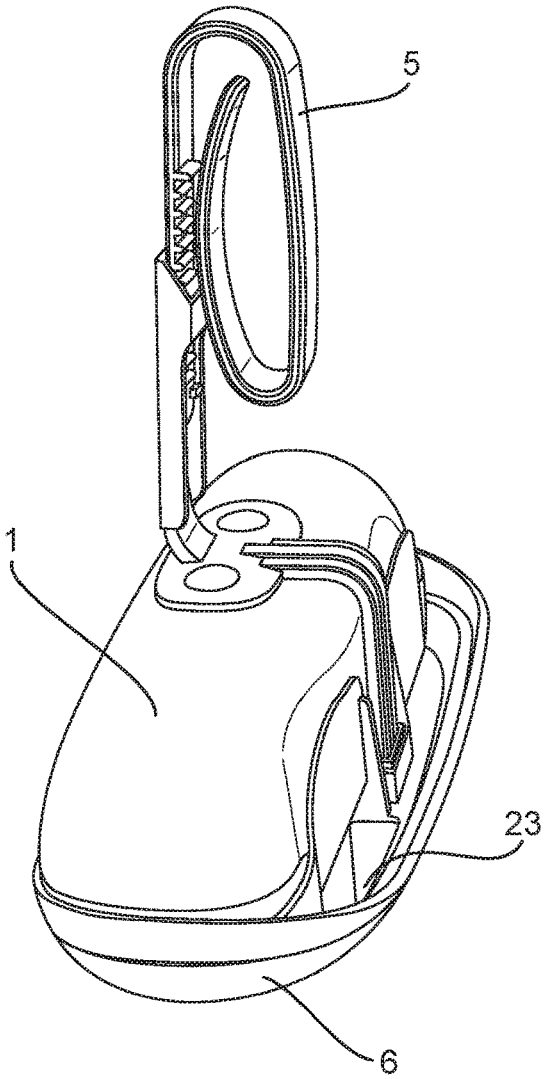
FIG. 5-7 are line drawings of an embodiment of the ITB of the invention
Figure 6:
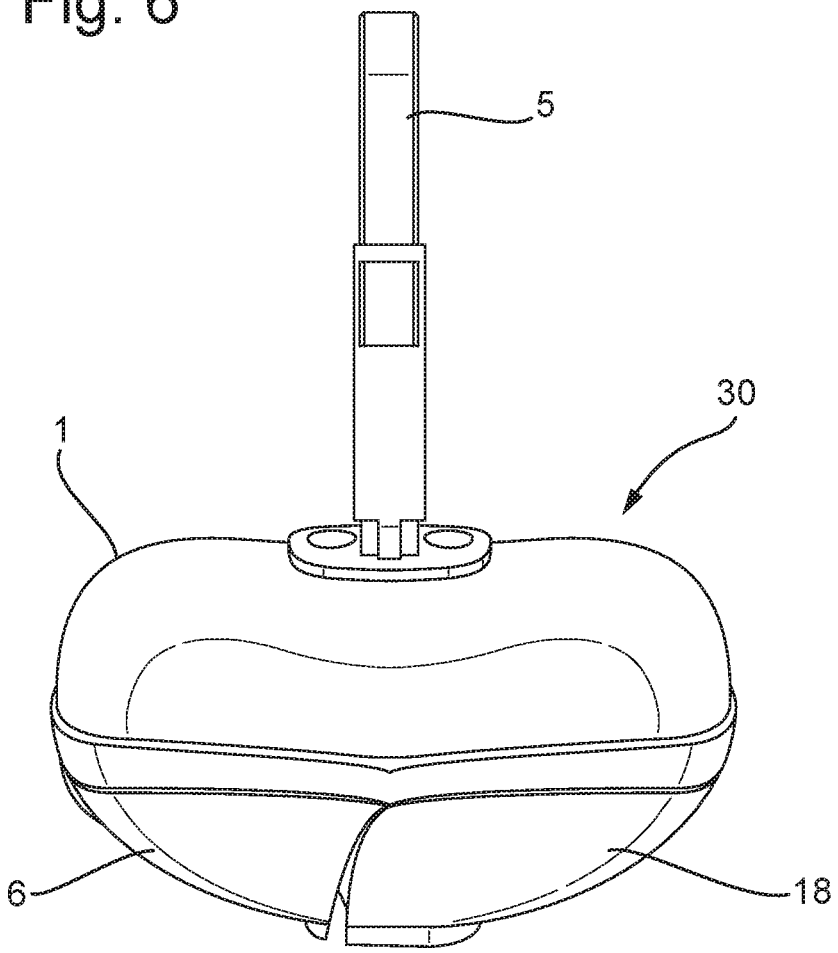
Figure 7:
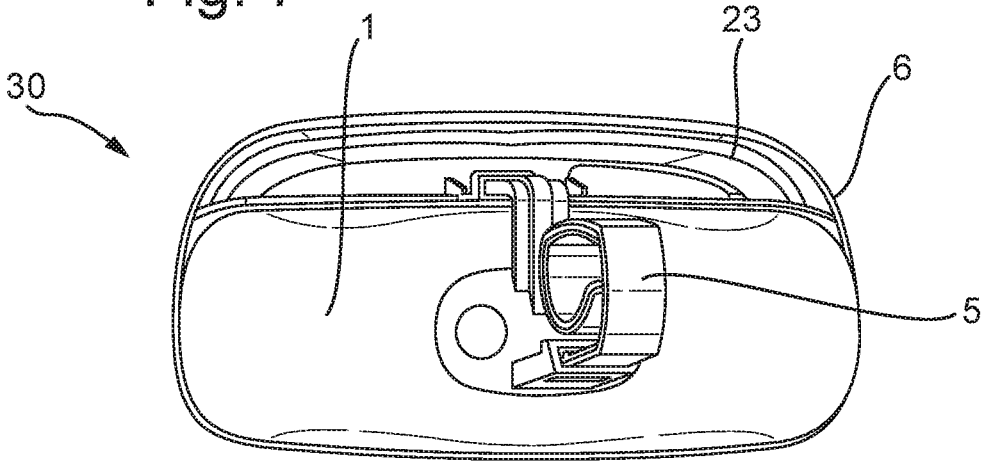

To facilitate an understanding of the principles and features of the various embodiments of the present invention, various illustrative embodiments are explained herein. Although exemplary embodiments of the present invention are explained in detail, it is to be understood that other embodiments are contemplated. Accordingly, it is not intended that the present invention is limited in scope to the details of construction and arrangement of components set forth in the description, figures or examples. The present invention is capable of other embodiments and of being practiced or carried out in various ways.

As used in the specification and the appended claims, the singular forms of "a", "an" and "the" include plural references unless the context clearly dictates otherwise. For example, reference to a component is intended also to include a composition of a plurality of components. References to a composition containing "a" constituent is intended to include other constituents in addition to the one named.

In describing the exemplary embodiments, terminology will be resorted to for the sake of clarity. It is intended that each term contemplates its broadest meaning as understood by those skilled in the art and includes all technical equivalents that operate in a similar manner to accomplish a similar purpose.

With respect to the components of the ITB, ranges may be expressed herein as from "about" or "approximately" or "substantially" one orientation and/or to "about" or "approximately" or "substantially" another particular orientation. When such a range is expressed, other exemplary embodiments include from the one particular orientation and/or to the other particular orientation.

By "comprising" or "containing" or "including" is meant that at least the named method step is present in the method, but does not preclude the presence of other method steps, even if such method steps have the same function as what is named.

It is also to be understood that the mention of one or method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the present invention are intended to be illustrative and not restrictive. Many suitable materials that would perform the same or a similar function as the materials described herein are intended to be embraced within the scope of the present invention. Such other materials not described herein can include, but are not limited to, materials that are developed after the time of the development of the present invention.

The device hereinafter described uses the well-known physical phenomenon that atmospheric pressure acting on a surface area of a pool of liquid can support a column of liquid within an inverted vessel or container (such a bottle) whose open end is submerged in the pool of liquid. The volume of the pool of liquid which is accumulated in the dosing cup is dependent on its height which in turn is dependent on a number of factors including the annular surface area of the pool, the viscosity of the liquid composition, its surface tension, and others. The ITB of the present invention can be readily adapted for use with a wide variety of liquid compositions having a viscosity within the range of 1 to 4,000 centipoises, more preferably 1 to 400 centipoises, and most preferably 1 to 40 centipoises at 25° C. to meet different criteria in terms of color, foam forming, odor release, desired number of flushing operations per bottle, and other considerations.

The ITB of the present invention (30) is intended to be positioned in a toilet bowl (TB) by means of a hook (5) or other suspension means. See, for example, FIG. 1.

The ITB of the present invention (such as depicted in FIGS. 2-7) comprises a single container or bottle (1) sitting within supporting cage/chassis (6). At least a portion of the supporting cage is arranged to divert the flow of flush water in use, deflector ramp 23. More specifically the deflector ramp (23) may form part of the receptacle (18) and/or lever arm (16). The bottle comprises a composition (2) for dosing into the toilet bowl post flush. The bottle (1) is preferably constructed of a clear plastic material compatible with the chemistry of their compositions (2). It is preferred that the bottle (1) is clear so that a consumer can easily view when the contents are empty and require replacement. It is also preferred that the supporting cage 6 comprises a piercing structure, preferably located in the liquid delivery means (21) to open the top of the bottle (1) on insertion into the cage (6). The plastic is preferably polyethylene terephthalate. The invention is also not limited in scope to the materials of construction of the various components of the invention. However, it is preferred that such components be constructed of a plastic, such as polyethylene. The skilled person will be aware of a wide range of different plastics that may be used.

According to the first aspect of the invention there is provided an in-the-bowl dispensing device for the automatic dispensing of a composition into a toilet bowl post flushing.

According to a second aspect of the invention there is provided a composition suitable for addition to a toilet bowl post flushing.

According to the third aspect of the present invention there is provided a method of automatically adding a composition to a toilet bowl post flushing. The method comprises attaching the dispensing device of the first aspect of the invention to a portion of a toilet bowl (TB) such that the device is within the interior of the toilet bowl and flushing the toilet to release a composition into the toilet after the flush cycle is complete or nearly complete. Preferably the composition released is according to the second aspect of the present invention. Preferably the composition is only released once the flush cycle is complete.

The use and operation of the ITB of the invention will now be described.

FIG. 8-13 disclose the working sequence of the device (30) during the flushing cycle.

Figure 8:
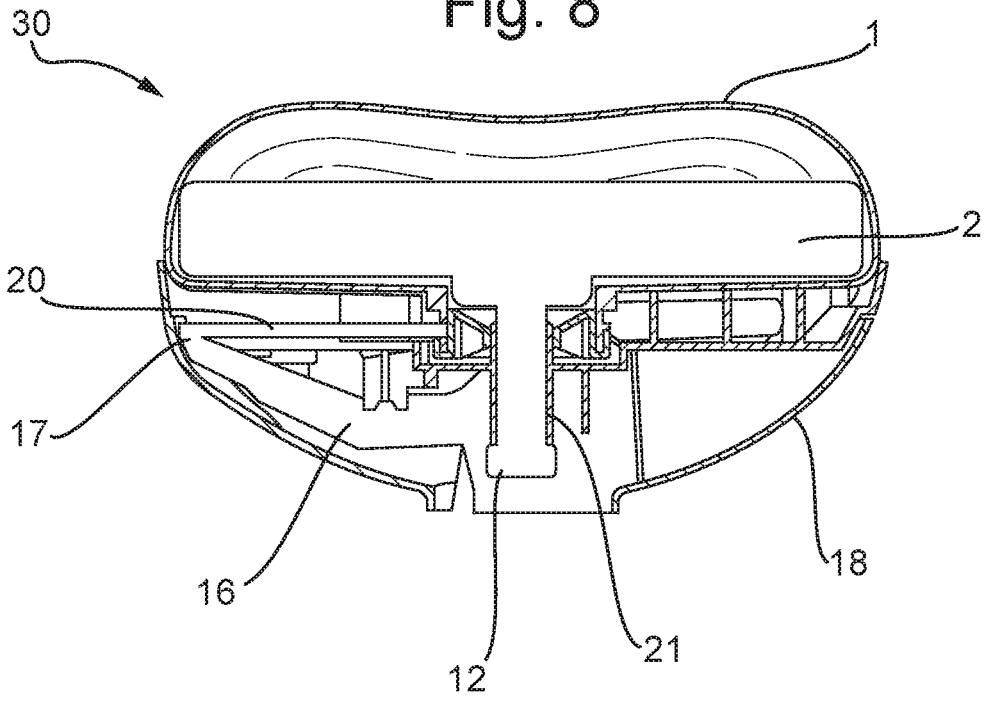
FIGS. 8-13 are schematics of the workings of an embodiment of the invention during a flush cycle
Figure 9:
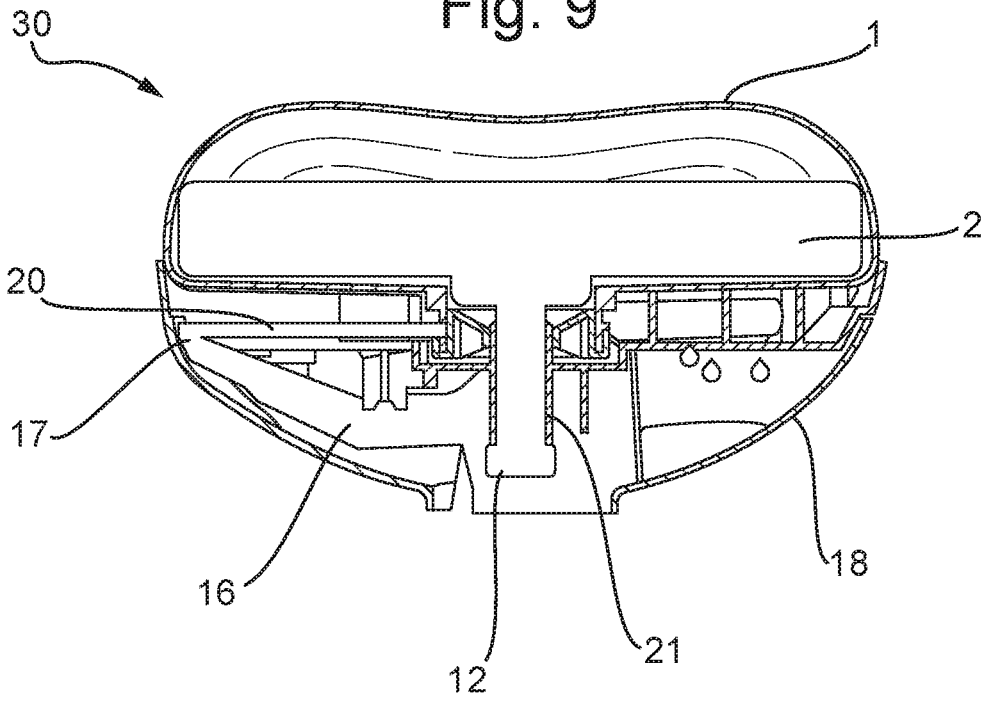
Figure 10:
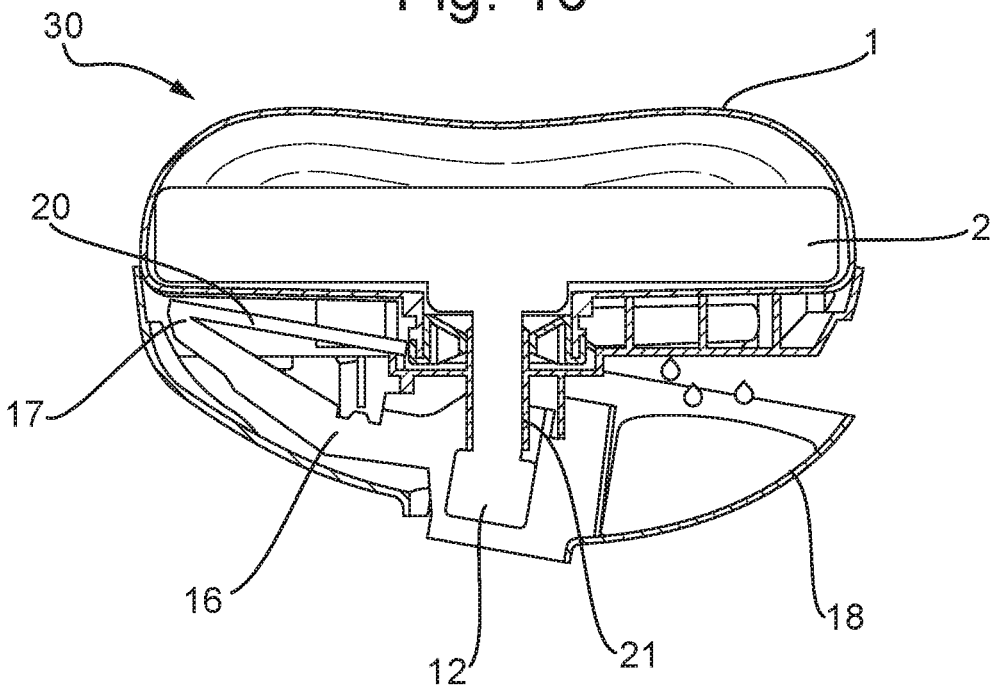
Figure 11:
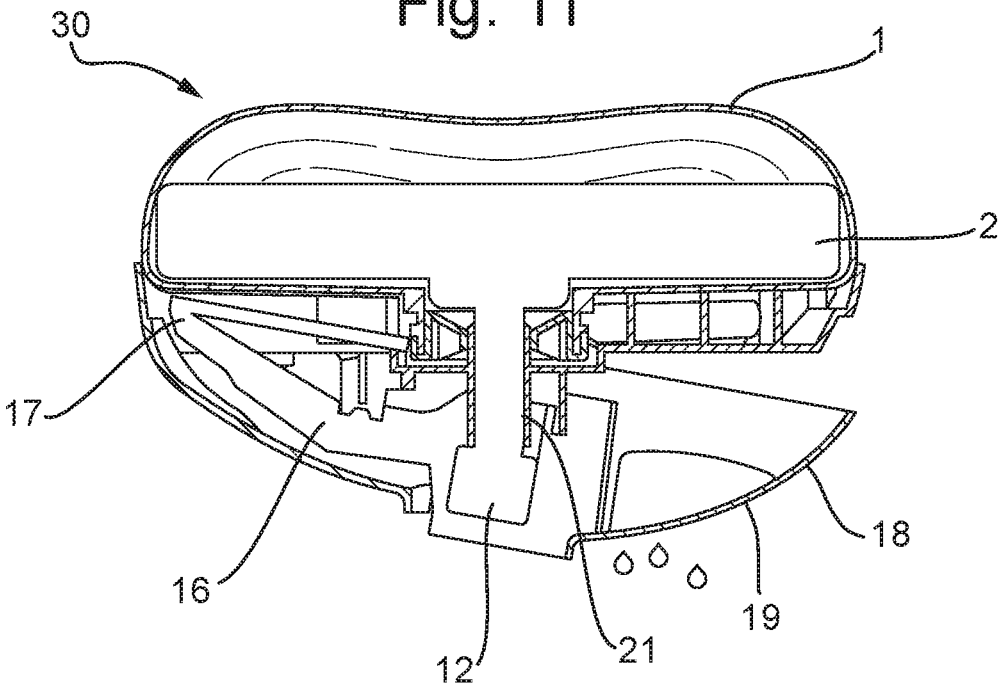

In the initial or pre-flush position, such as depicted in FIG. 8, composition (2) is not dispensed from the ITB into the toilet bowl (TB). The lever arm (16) is biased by spring (20) into an approximately horizontal orientation. The cleaning composition dosing cup (12) surrounds a portion of liquid flow chamber (21) including its exit and is in fluid communication with the bottle (1) containing the composition (2). The composition dosing cup (12) is partially filled with the composition (2) to a level where equilibrium is reached between the contents of the bottle containing the composition (1) and the atmospheric pressure on the surface of the composition in the dosing cup (2). The exit from liquid flow chamber (21) is submerged within the cleaning composition within the composition dosing cup (12). Factors affecting this equilibrium are gravity, the surface tension and viscosity of the composition (2), the geometry of liquid flow chamber (21) and the geometry of the composition dosing cup (12). Also considered is the distance from the bottom of the composition dosing cup (12) to the exit of the liquid flow chamber (21). That is, the volume of the composition dosing cup (12) not occupied by liquid flow chamber (21).

There is no discharge in the initial or pre-flush position from the composition dosing cup (12) into the toilet bowl.

At the initiation of the second or flushing position, when a user flushes the toilet, a portion of the flush water (FW) comes into contact with the deflector ramp (23). See FIGS. 9 and 10. The deflector ramp (23) is inclined downward towards the receptacle (18) and thus directs that portion of the flush water into the receptacle (18) disposed at one end of lever arm (16).

This portion of the flush water is temporarily retained in the receptacle (18).

The weight of the retained flush water (FW), biases the lever arm (16) around the pivot point (17), against the force of the spring (20), such that the receptacle (18) moves downwards toward the bottom of the toilet bowl (TB). See FIG. 10.

This movement of the lever arm (16) around pivot point (17) simultaneously moves the fragrance composition dosing cup (12) downward and further away from the exit of liquid flow chamber (21) associated with the bottle (1) of composition (2). By moving in this position, the volume of the composition dosing cup (12) not occupied by the composition flow chamber (21) increases and fluid communication between the fragrance composition dosing cup (12) and the liquid flow chamber (21) for the composition is temporarily disrupted. Air is thus permitted to enter the bottle (1) containing the composition (2) and, as a result, an additional volume of composition (2) can flow downward through the liquid flow chamber (21) and into the dosing cup (12). This continues until equilibrium is reached between the composition (2) in the bottle (1) and the composition (2) in the fragrance dosing cup (12). There is no discharge in this position from the dosing cup (12).

The drainage hole or holes (19) in the receptacle (18) is/are specifically sized to slowly release to the toilet that portion of the flush water that was retained in the receptacle (18). As the flush water retained in the receptacle (18) is slowly released back to the toilet bowl, (see FIG. 11) the weight of the flush water in the receptacle (18) is reduced and removed from the lever arm (16).

Figure 12:
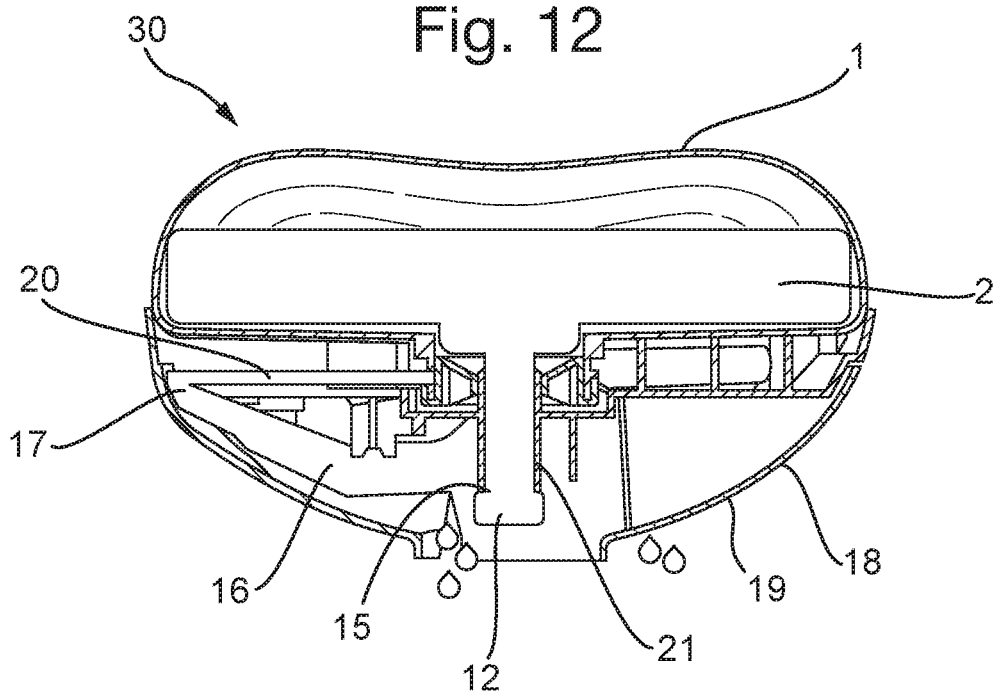

In the third or post-flush position, (see FIG. 12), when the weight of the flush water in the receptacle (18) has been sufficiently reduced, and preferably when all of the flush water in the receptacle has been released, the lever arm (16) is biased by the spring (20) around the pivot point (17) in a manner such that the cleaning composition dosing cup (12) is moved upwards, the volume of the fragrance composition dosing cup (12) not occupied by liquid dosing chamber (21) decreases such that a volume of the composition (2) is displaced from the dosing cup (12) via a drip point (15) (See FIG. 12).

Figure 13:
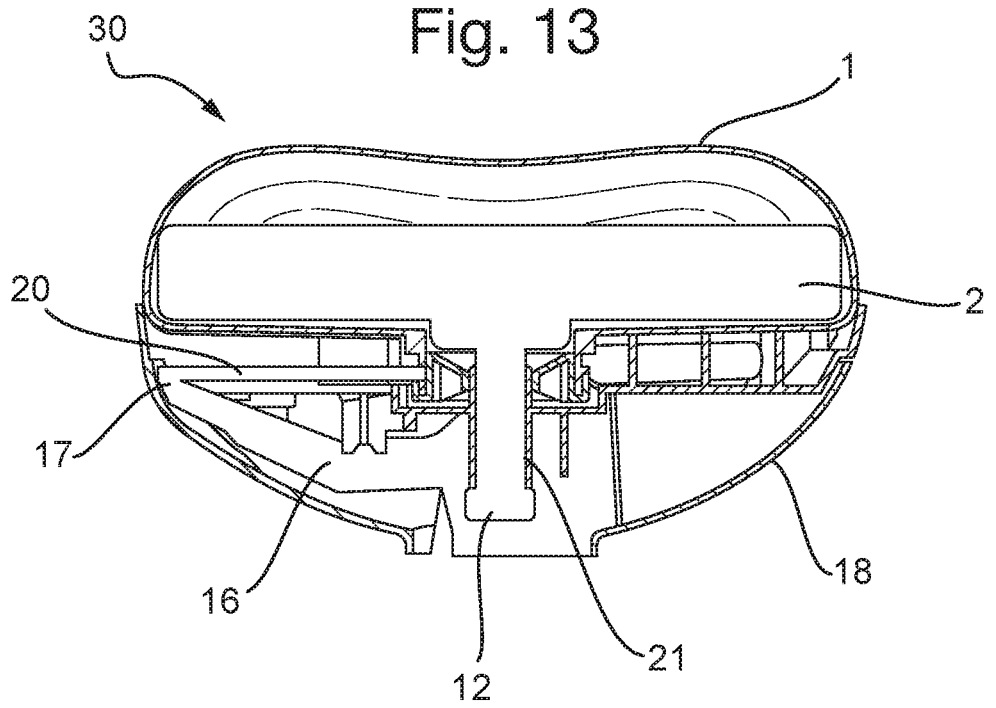

The geometry and surface area of drip point (15) cooperates with the surface tension and viscosity of the portion of fragrance composition displaced from the fragrance composition dosing cup (12) such that the displaced portion of the composition (2) will drip from drip point (15) into the water in the toilet bowl (TB) near the end of or after the flushing operation is completed. The device is then returned to its starting position (FIG. 13). Preferably the composition (2) enters the toilet bowl once the flushing operation is complete.

In this manner, the entry of the displaced dose of fragrance composition into a toilet bowl is delayed until near the end of or preferably after the flushing operation has been completed. Due to its essential oil characteristics and the fact that the flushing operation of the toilet bowl has ceased, the displaced dose of fragrance composition is able to spread across and float on the top of the water remaining in the toilet bowl to create a barrier. When a subsequent user defecates into the toilet bowl, malodors associated with the feces are trapped beneath the essential oil barrier, thus eliminating or reducing the amount of malodor emitted from the feces into the air within the bathroom. Thus the essential oil barrier provides both a malodor reduction and fragrancing benefit.

The device (30) of the present invention allows for a consistent and repeatable dosage of composition (2) into the toilet bowl post flush. Although the present invention is not restricted to a particular amount of composition dosed into the toilet bowl, in a preferred embodiment, the displaced dose of fragrance composition is preferably between about 0.05 mL to about 5 mL, more preferably between about 0.1 mL and about 1.0 mL and most preferably between 0.2 mL and 0.5 mL. The device of the present invention can be altered so that in principle any dosage amount desired is achievable.

Compositions

The invention is not restricted to particular formulations. The device will dose any composition into the toilet bowl. Particularly preferred formulations comprise fragrance formulations. In particular fragrance formulations further comprising a barrier or film forming layer component on water.

The compositions of the present invention maybe natural products such as essential oils. These compositions comprise both the desired fragrance and oily barrier forming layer components.

Essential oils are not without their problems. Often essential oils comprise components that are irritants to human tissues.

Man-made fragrance compositions are also preferred. The man-made or synthetic compositions of the present invention are preferably aqueous. The preferred compositions of the present invention preferably comprise between 20 and 90% by weight of water, more preferably between 30 and 70% by weight of water and most preferably between 40 and 60% by weight water.

The compositions preferably comprise a fragrance composition comprising between 5 and 50% by weight, more preferably between about 10 and 40% by weight, more preferably between about 25% and 35% by weight.

The compositions preferably comprise a barrier layer component comprising between about 5 and 40% by weight, more preferably between 10 and 30% by weight and most preferably between about 15 and 25% by weight.

Any chemical capable of forming a layer on top of the water in the toilet bowl may comprise a barrier layer component. Particularly preferred barrier layer components include PEGs and PPGs.

The compositions of the present invention may further include additional minor components. These may include dyes, preservatives, surfactants, bleaches, hydrogen peroxide, quaternary ammonium compounds and other actives effective against microorganisms typically found in a toilet bowl environment, antimicrobials, thickeners, disinfectants, pH modifiers, etc. Preferably the minor components comprise between about 0 and 20% by weight.

A particularly preferred composition for the device and method of the present invention is detailed on the table below.

| AST Formulation | % |
|---|---|
| Water | 52.990 |
| Dye | 0.010 |
| Fragrance | 30.000 |
| PEG 40 | 17.000 |
| | 100.000 |

CONCLUSION

Numerous characteristics and advantages have been set forth in the foregoing description, together with details of structure and function. While the invention has been disclosed in several forms, it will be apparent to those skilled in the art that many modifications, additions, and deletions, especially in matters of liquid compositions, as well as shape, size and arrangement of parts, can be made therein without departing from the spirit and scope of the invention and its equivalents as set forth in the following claims. Therefore, other modifications or embodiments as may be suggested by the teachings herein are particularly reserved as they fall within the breadth and scope of the claims here appended.

What is claimed is:

1. A dispensing device which dispenses a composition into a toilet bowl, the device comprising:

a) a container containing a composition suitable for dispersing into a toilet bowl wherein the composition is flowable and comprises:
   1) water 20-90%;
   2) barrier layer component 5-50%;
   3) fragrance 5 40%; and
   4) optional ingredients 0-20%;

b) a supporting cage supporting the container, the supporting cage having a means for conveying the composition to a dosing cup;

c) a lever arm pivotably connected to the supporting cage by a pivot point; the lever arm comprising the dosing cup;

d) a receptacle which temporarily retains a portion of the flow of flush water exiting from the rim of a toilet bowl during a toilet flush; wherein the receptacle comprises one or more drainage holes; and e) a suspension means for suspending the supporting cage from a portion of the toilet bowl to position the supporting cage within the flow of water exiting from the rim during a toilet flush such that at least a portion of the flow of exiting water is directed into the receptacle during a toilet flush; and wherein during the toilet flush, the weight of the flush water retained in the receptacle causes the lever arm to rotate from its initial biased position about the pivot point and cause the composition to move from the container to the dosing cup and during which there is no discharge of the composition from the dosing cup to the exiting water present within the receptacle; and subsequently, at the end of the toilet flush, the lever arm returns to its initial position and causes the composition to be dispensed from the dosing cup and into the toilet bowl without contacting exiting water present within the receptacle.

2. The device of claim 1 wherein the composition provides a fragrancing benefit.

3. The device of claim 1 wherein the composition provides a fragrancing benefit and/or a barrier layer to the surface of the water in the bowl.

4. The device of claim 1 wherein the means for conveying is a liquid flow chamber.

5. The device of claim 1 wherein the dosing cup comprises a drip point.

6. The device of claim 1 wherein the receptacle comprises two or more drainage holes.

7. The device of claim 1 wherein said lever arm further comprises a deflector ramp.

8. The device of claim 1 wherein the composition is a liquid.

9. The device of claim 1 wherein the composition has a viscosity of between 1 and 400 centipoise.

10. The device of claim 1 wherein the barrier layer component is a PEG or a PPG compound.

11. The devices of claim 1 wherein the optional ingredients are selected from the group which includes: dyes, preservatives, antimicrobials, thickeners, bleaches, surfactants and pH modifiers.

12. The dispensing device of claim 1, wherein the dosing cup is disposed on the lever arm distal to the pivot point.

13. The device of claim 1 wherein the composition is a liquid composition.

14. The device of claim 13 wherein the means for conveying the composition to the dosing cup is a liquid flow chamber.

15. The device of claim 13 wherein the ratio of the cross-sectional area of a liquid flow chamber to its length is at least 2.5:1.

16. A method of automatically adding a composition to a toilet bowl post flushing, comprising the step of:

placing the device of claim 1 on the inner edge of the toilet bowl and spending it from the toilet bowl rim.

17. The method of automatically adding a composition to a toilet bowl according to claim 16, wherein the composition has a viscosity of between 1 and 400 centipoise.

18. The method of automatically adding a composition to a toilet bowl according to claim 16, wherein the barrier layer component is a PEG or a PPG compound.

* * * * *